United States Patent [19]

Sando et al.

[11] Patent Number: 4,742,697

[45] Date of Patent: May 10, 1988

[54] APPARATUS FOR CONTINUOUS WET HEAT TREATMENT OF A CLOTH

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 890,833

[22] Filed: Jul. 25, 1986

[30] Foreign Application Priority Data

Aug. 7, 1985 [JP] Japan ..... 60-121355
Aug. 7, 1985 [JP] Japan ..... 60-173893

[51] Int. Cl.[4] ..... D06B 5/08
[52] U.S. Cl. ..... 68/5 D; 68/20; 68/62; 68/205 R
[58] Field of Search ..... 68/5 D, 5 E, 13 R, 20, 68/62, 205 R

[56] References Cited

U.S. PATENT DOCUMENTS 2,777,750 1/1957 Sprague et al. ..... 68/5 (D) X
3,730,679 5/1973 Schuierer ..... 68/20 X
3,750,428 8/1973 Bruckner ..... 68/5 (E) X
3,771,952 11/1973 Holm ..... 68/205 (R) X

FOREIGN PATENT DOCUMENTS 632794 10/1963 Belgium ..... 68/5 (D)

*Primary Examiner*—Philip R. Coe
*Attorney, Agent, or Firm*—Toren, McGeady & Associates

[57] ABSTRACT

An apparatus for continuous wet heat treatment of a cloth, comprising a water tank for applying high temperature hot water to a cloth soaked with a treating solution so as to swell the cloth, and a tenter for transporting the thus swelled cloth while giving tension in the width direction of the cloth, and providing three groups of jet nozzles for jetting, respectively, a high temperature and high humidity hot fluid, hot blast and cold blast in succession along the direction of transporting the cloth by means of the tenter.

3 Claims, 3 Drawing Sheets

APPARATUS FOR CONTINUOUS WET HEAT TREATMENT OF A CLOTH

BACKGROUND OF THE INVENTION

1. Field of the Invention

The present invention relates to an apparatus for continuous wet heat treatment of a cloth, by which such treatments as pretreatment, dyeing, color development, weight reduction and setting (hereinafter will be called dyeing and weight reduction) can continuously and speedily be done, by using a tenter for transporting a long cloth continuously while broadening the cloth in its width direction (i.e., under width expansion) due to the effect of said tenter and applying high temperature hot water to the cloth by jetting hot water thereto.

2. Description of the Prior Arts

For subjecting a long cloth commercially produced to such treatments as dyeing and weight reduction continuously by the use of a wet heat reaction, the use of such apparatuses as "Perble Range" (commercial name by Sando Iron Works Co., Ltd.) developed by the present inventors or a high pressure steamer has been proposed. However, "Perble Range" is mainly used for the pretreatment of a cloth, not suited for the use of such treatments as dyeing and weight reduction, and it is rather impossible to apply "Perble Range" for such treatments. In using "Perble Range", a cloth fed in it is wet heat treated successively in batches in the folded and piled state, so that almost no tension is applied in the lengthwise direction of the cloth. Therefore, a cloth can be made shrinkable, but there occur such shortcomings as formation of creases and occurrence of unevenness at the bent parts because the cloth is treated in the folded state, and accordingly no satisfactory treatment can be done by using "Perble Range". When further subjecting a cloth pretreated by "Perble Range" to such treatments as dyeing and weight reduction, the cloth must be treated anew by the use of a different apparatus, necessitating many processes and a long period of time until a series of the treatments is finished. On the other hand, in the case of using a high pressure steamer, a long cloth is transported by the use of a plurality of guide rolls, so that it is possible to reduce the occurrence of creases and unevenness in the treatment. However, the cloth guided by means of a plurality of guide rolls is transported through the steamer body zigzag forming snaky undulations, so that a tension is caused to occur unavoidably in the longitudinal direction of the cloth, causing irregularity in the dimension of the cloth in its width direction. Thus, a cloth with an accurate size can hardly be produced in the case of using a high pressure steamer.

In applying a high pressure steamer, furthermore, since the steamer body must be maintained with a high temperature and a high humidity atmosphere prior to the wet heat treatment of a cloth, it needs a long period of time until the interior of the steamer body is made into a suitable condition, thus prolonging the preparatory time and consuming a large quantity of heat energy. Furthermore, in the case when the steamer body is provided with a pair of seal mechanisms at the inlet and outlet sides of the cloth for maintaining the interior of the steamer body with a high temperature and a high pressure atmosphere while allowing the continuous introduction and taking out of the cloth therethrough, the whole arrangement of the steamer body becomes complicated, and it is unavoidable that the size of the apparatus becomes large, increasing the installation cost. Accordingly, the present inventors have proposed a high temperature hot water jet nozzle, which blows a high temperature and a high humidity vapor directly to the cloth to be treated by the jetting force of hot water so as to speed up the operation of wet heat treatment and simplify the arrangement of the apparatus. However, the structure of the proposed jet nozzle has such a drawback that, even when the temperature of water to be jetted from the nozzle is increased, for example, to about 150° C., water is partially evaporated immediately after it is jetted from the nozzle, decreasing the temperature of the vapor suddenly, scattering the vapor and losing the wet heat energy.

SUMMARY OF THE INVENTION

Under such circumstances, the object of the present invention is to provide an improved apparatus for continuous wet heat treatment of a cloth under an ordinary atmospheric pressure by the use of a single and cheap apparatus, by which a series of the treatments comprising, for instance, pretreatment, color development, setting and drying in succession can speedily be done to produce an excellent quality of product, and simultaneously to provide a jet nozzle to be applied to the apparatus by which high temperature hot water and/or cold blast can be jetted to the cloth effectively.

The gist of the apparatus according to the present invention comprises a water tank for applying high temperature hot water to a cloth soaked with a treating solution so as to swell the cloth, and a tenter for transporting the thus swelled cloth while being expanded in width, and providing three groups of jet nozzles for jetting, respectively, a high temperature and a high humidity hot fluid, hot blast and cold blast to the cloth in succession along the direction of transporting the cloth by means of the tenter. Two kinds of high temperature and high humidity hot fluid jet nozzles have also been disclosed.

DETAILED DESCRIPTION OF THE PREFERRED EMBODIMENTS

Figure 1:
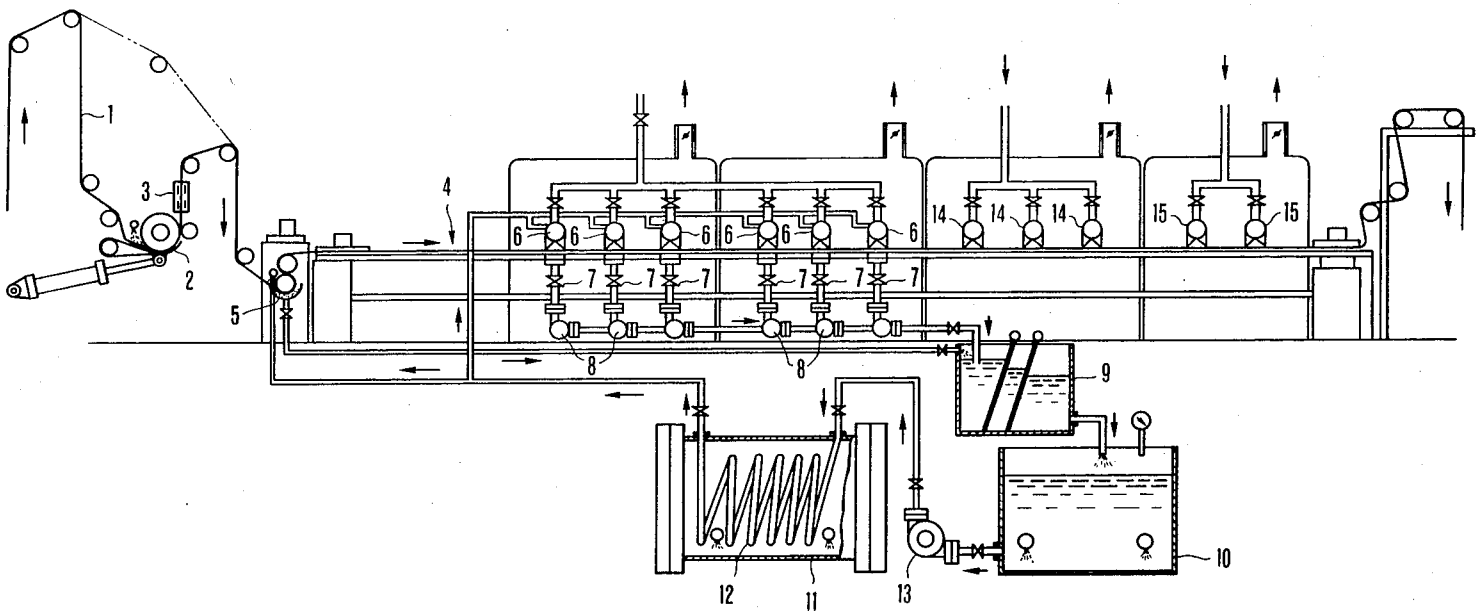
FIG. 1 is an explanatory drawing showing an example of the apparatus for continuous wet heat treatment of a cloth according to the present invention.

The present invention will be described in detail hereinbelow referring to the drawings showing the examples thereof.

The apparatus shown in FIG. 1 is suitable for subjecting a long cloth, for instance, to dyeing, setting and drying in series by the use of a single apparatus. In the drawing, 1 is a cloth to be treated, 2 is a treating solution tank in which a treating solution, for instance a dye solution, to be used for the treatment is introduced, 3 is an intermediate drier by the use of infrared rays for fixing the treating agent applied to the cloth tentatively, and 4 is a tenter for transporting the cloth 1. 5 is a hot water tank for supplying hot water to the cloth 1 for the purpose of swelling the cloth immediately before the cloth is supplied to the tenter 4 and thus to facilitate the width expansion of the cloth by the tenter 4. The tenter 4 is designed so as to clip both edges of the cloth for giving tension thereto in its width direction in order to expand the width of the cloth. Any tenter with a known construction may suitably be applied. 6 represents a plurality of high temperature and high humidity fluid jet nozzles for jetting a high temperature and a high humidity hot fluid to the cloth 1 passing under tension by means of the tenter 4 from the upper side thereof, and 7 represents a group of suction means provided at the lower side of the cloth for recovering hot water applied to the cloth by suction.

Figure 2:
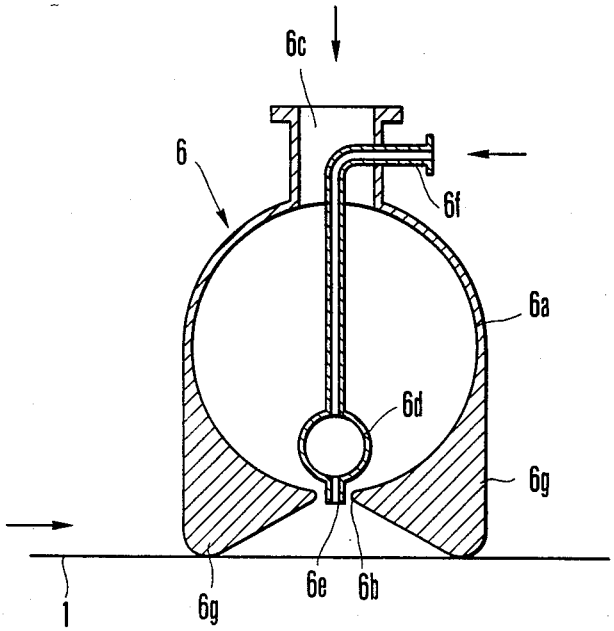
FIG. 2 is an enlarged sectional diagram of a example of the high temperature and high humidity fluid jet nozzle according to the present invention.

The arrangement of the high temperature and high humidity fluid jet nozzle 6 is as shown in FIG. 2. In the drawing, *6a* is an outer nozzle pipe having an outer nozzle opening *6b* extending in the width direction of the cloth, and a hot blast supply opening *6c* is attached to the outer nozzle pipe *6a* for supplying hot blast, for instance, at a temperature from 250° to 270° C., thereto. An inner nozzle pipe *6d* is provided at the inside of the outer nozzle pipe *6a*. The inner nozzle pipe *6d* has an inner nozzle opening *6e* positioned at the central part of the outer nozzle opening *6b* and a high temperature hot water supply opening *6f* for supplying high temperature water, for instance at about 150° C., thereto.

Furthermore, the outer nozzle pipe *6a* is provided with a pair of frames *6g* with a section as shown in FIG. 2 adjacent to both sides of the outer nozzle opening *6b* en bloc so as to contact the frames *6g* with the cloth 1 transported by means of the tenter 4. The frames *6g* are to prevent the scattering of the fluid jetted from the fluid jet nozzle 6.

In FIG. 1, 8 represents a group of suction pumps, and 10 is a liquid tank for receiving water coming out of the suction pumps 8 via a filter 9. 11 is a pressure vessel so as to maintain the interior thereof with a high temperature atmosphere, for instance at about 150° C., by introducing high pressure steam therein, and 12 is a hose provided in the interior of the pressure tank 11. It is so designed that, by supplying water from the liquid tank 10 to the hose 12 by means of a pump 13, the temperature of water therein is raised nearly to a temperature about 150° C. for jetting the water to the cloth by means of the inner nozzle opening *6e*. 14 represents a group of hot blast jet nozzles for jetting hot blast to the cloth in succession to the high temperature and high humidity fluid jet nozzles 6 for the purpose of drying the cloth, and 15 represents a group of cold blast jet nozzles for cooling the cloth thus treated. While a plurality of high temperature and high humidity fluid jet nozzles are divided into two chambers in this example, the number of the chambers may suitably be selected from one to a plural number according to circumstances.

Now, the function of this apparatus will be explained in the case of dyeing a cloth. A cloth 1 to be treated is soaked with a dye solution in the treating solution tank 2, and passed through the intermediate drier 3 for fixing the dye applied to the cloth tentatively by drying. The thus treated cloth is introduced in the hot water tank 5 for increasing the swellability of the cloth, and the thus swelled cloth is transported immediately thereafter by applying tension in its width direction by means of the tenter 4. Thus, the transportation of the cloth can effectively be done without difficulty. While the transportation of the cloth is done in this way, a mixed fluid comprising hot water, for rnstance at a temperature about 150° C., and hot blast, for instance at 250° to 270° C., is jetted to the cloth from the high temperature and high humidity fluid jet nozzles 6. The high temperature and high humidity fluid directly applied to the cloth 1 is nearly at a temperature of 200° C., and therefore, the cloth can be swelled sufficiently. Consequently, the dye tentatively fixed on the surface of the cloth is permeated up to the core part of the cloth, and the fixation of the dye can surely be performed all over the cloth. Since high temperature hot water at about 150° C. jetted from the inner nozzle opening *6e* is pressurized, the water is evaporated immediately after it is jetted causing the sudden drop of the temperature, but due to the synergistic effect of the water and the high temperature blast at a temperature of 250° to 270° C. jetted from the outer nozzle opening *6b*, the swelling of the cloth can be done promptly and effectively. Under circumstances, the supply of hot blast from the outer nozzle pipe *6a* may be omitted to obtain a satisfactory result. The thus dyed cloth by means of the wet heat treatment as mentioned above is transported into the hot blast drying zone, dried by the hot blast jetted from the group of hot blast jet nozzles 14, and the resultant cloth is finally cooled by the cold blast jetted from the jet nozzles 15, and taken out of the tenter 4 for the subsequent processes.

As described above, in this example, since high temperature water is applied to the cloth immediately before the cloth is supplied to the tenter, the cloth is swelled sufficiently prior to entering the tenter, and accordingly, the cloth can be transported through the tenter smoothly under tension in its width direction by the tenter. The cloth is wet heat treated by applying high temperature and high humidity fluid at a temperature about 200° C. thereto, and then subjected to drying and cooling in succession. Therefore, a series of dyeing, setting and drying of a long cloth can smoothly and continuously be done in succession by the use of a single tenter to produce a cloth of uniform and excellent quality effectively.

While the dyeing of a cloth has been explained above, such treatments as pretreatment and weight reduction of a cloth can similarly be done using the apparatus in this example. In the pretreatment and weight reduction of a cloth, a caustic alkali solution is applied. In such instances, the cloth is not contacted with air from the wet heat treatment until cooling, so that the danger of oxidation of the cloth can perfectly be prevented.

Figure 3:
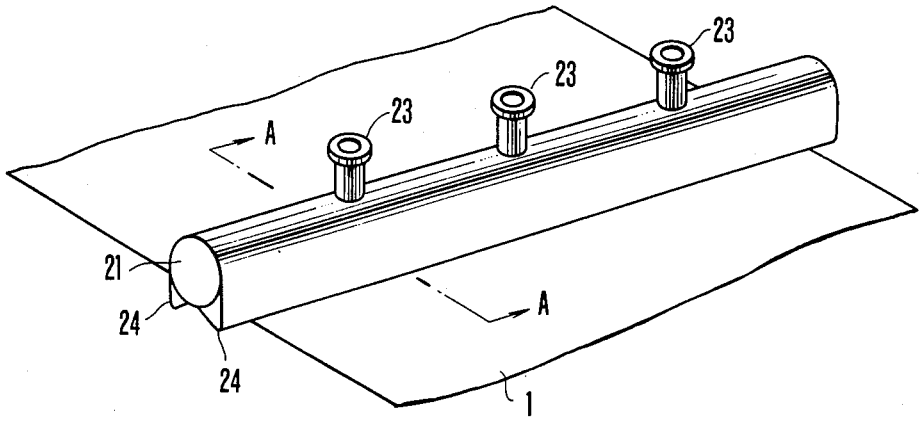
FIG. 3 shows the oblique view of another example of the high temperature and high humidity fluid jet nozzle according to the present invention.
Figure 4:
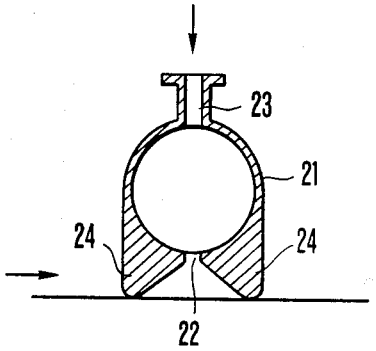
FIG. 4 is the sectional diagram thereof at the line A—A.

FIGS. 3 and 4 show another example of the high temperature and high humidity fluid jet nozzle to be applied to the apparatus according to the present invention. In the drawings, 21 is a pressure- and heat-resistant high temperature hot water jet pipe provided with a plurality of nozzle openings 22 with a shape of fine pore or slit along the mother line thereof, and a group of high temperature hot water supply openings 23 at a suitable positions along the lengthwise direction thereof. 24 represents a pair of frames with a section as shown in FIG. 4 provided adjacent to both sides of the nozzle opening 22 en bloc so as to contact the frames with the cloth 1 transported by means of the tenter 4 for preventing the scattering of the fluid jetted from the nozzle opening 22. The function of this high temperature and high humidity fluid jet nozzle is similar to that of the preceding one in FIG. 2. This type of high temperature and high humidity fluid jet nozzle is merely to apply high temperature hot water without using hot blast, so that its construction is simple and is applicable suitably in accordance with the nature of treatment. Furthermore, while the high temperature and high humidity fluid jet nozzle in this example is used for the application of hot water, the nozzle may suitably be applied for such cases as jetting of cold water as well as hot and cold blast.

As described above, in the apparatus for continuous wet heat treatment of a cloth according to the present invention, it is possible to transport a cloth to be treated while being expanded in width by a single tenter without difficulty. The apparatus is quite suited for the continuous treatment of a long cloth such as dyeing and weight reduction under an ordinary atmospheric pressure together with setting and drying after the treatment in succession. Since the treatment is done by the use of a single apparatus continuously, it is possible to produce a uniform and excellent product. Furthermore, since the construction of the apparatus is very simple at an ordinary atmospheric pressure, the production cost can remarkably be reduced. Thus, the effect of the apparatus is quite distinguished, and the apparatus is particularly suitable for massproduction.

What is claimed is:

1. An apparatus for continuous wet heat treatment of a cloth, comprising:

a water tank for applying high temperature hot water to a cloth soaked with a treating solution so as to swell the cloth, and a tenter for transporting the thus swelled cloth while giving tension in the width direction of the cloth, and three groups of jet nozzles for jetting, respectively, a high temperature and high humidity hot fluid, hot blast and cold blast to the cloth in succession along the direction of transporting the cloth by means of said tenter.

2. An apparatus according to claim 1, wherein one group of jet nozzles comprises an outer nozzle pipe having an outer nozzle opening for jetting high temperature hot blast to the cloth, an inner nozzle pipe having an inner nozzle opening provided at the inside of the outer nozzle pipe for jetting high temperature hot water to the cloth, and a pair of frames at both sides of the outer nozzle opening en bloc so as to contact the frames with the cloth transported by means of the tenter for preventing the scattering of the fluid jetted from the inner and outer nozzle openings.

3. An apparatus according to claim 1, wherein one group of jet nozzles comprises a nozzle pipe having a nozzle opening for jetting high temperature hot water to the cloth, and a pair of frames at both sides of the nozzle opening en bloc so as to contact the frames with cloth transported by means of the tenter for preventing the scattering of the fluid jetted from the nozzle opening.

* * * * *